US006681918B2

(12) United States Patent
Wahle

(10) Patent No.: US 6,681,918 B2
(45) Date of Patent: Jan. 27, 2004

(54) DEVICE FOR REMOVING ROD-SHAPED OBJECTS, IN PARTICULAR CIGARETTE RODS OR CIGARETTE FILTER RODS

(75) Inventor: Jan Wahle, Reinbek (DE)

(73) Assignee: Hauni Maschinenbau AG, Hamburg (DE)

( * ) Notice: Subject to any disclaimer, the term of this patent is extended or adjusted under 35 U.S.C. 154(b) by 43 days.

(21) Appl. No.: 10/117,329

(22) Filed: Apr. 8, 2002

(65) Prior Publication Data

US 2002/0147089 A1 Oct. 10, 2002

(30) Foreign Application Priority Data

Apr. 6, 2001 (DE) ..... 101 17 082

(51) Int. Cl.[7] ..... B65G 47/24
(52) U.S. Cl. ..... 198/412; 198/406; 198/417
(58) Field of Search ..... 198/389, 390, 198/400, 406, 412, 417

(56) References Cited

U.S. PATENT DOCUMENTS 3,235,060 A * 2/1966 Gamberini ..... 198/412 X
3,863,751 A * 2/1975 Vignon ..... 198/412 X
5,058,725 A * 10/1991 Gamberini et al. ..... 198/406
5,116,298 A 5/1992 Bondanelli et al.
5,765,675 A * 6/1998 Draghetti et al. ..... 198/412 X

FOREIGN PATENT DOCUMENTS

| | | | | |
|---|---|---|---|---|
| CA | 718729 | * | 9/1965 | ..... 198/417 |
| DE | 33 12 841 A1 | | 11/1983 | |
| EP | 0 409 443 A2 | | 1/1991 | |
| EP | 0409443 B1 | | 1/1991 | |
| IT | 622934 | * | 4/1961 | ..... 198/417 |
| WO | WO 97/07694 A1 | | 3/1997 | |

* cited by examiner

*Primary Examiner*—James R. Bidwell
(74) *Attorney, Agent, or Firm*—Venable LLP; Robert Kinberg

(57) ABSTRACT

A device for removing rod-shaped objects from a production line includes a turning arrangement adapted for receiving the rod-shaped objects removed from the production line. The turning arrangement has at least one essentially fixed in place and rigid guide mechanism for swiveling the rod-shaped objects. A transporting mechanism receives the swiveled rod-shaped objects from the turning arrangement transports the swiveled rod-shaped objects to a remote location

17 Claims, 2 Drawing Sheets

DEVICE FOR REMOVING ROD-SHAPED OBJECTS, IN PARTICULAR CIGARETTE RODS OR CIGARETTE FILTER RODS

CROSS-REFERENCE TO RELATED APPLICATIONS

Priority is claimed with respect to German application No. 101 17 082.3 filed in Germany on Apr. 6, 2001, the subject matter of which is incorporated herein by reference.

BACKGROUND OF THE INVENTION

The invention relates to a device for removing rod-shaped objects, in particular cigarette rods or cigarette filter rods, from a production line for processing, in particular for tobacco processing, and for conveying the previously removed, rod-shaped objects to a remote location, in particular for a periodic check. The device comprises a turning arrangement for turning the rod-shaped objects.

A device of this type is generally used for monitoring the production of cigarette filters by removing filters periodically and at predetermined intervals from the production line. The device is used for checking filter dimensions, material, quality and/or other relevant criteria, in particular in a remote testing station, to draw conclusions concerning the production quality. A turning arrangement is provided because the removed, individual cigarette filter rods are generally conveyed in a longitudinal direction while they are generally positioned at a different angle for the removal from the production line. Thus, the cigarette filter rods can be oriented accordingly and then transported off. To be sure, the cigarette filter rods are normally transported in the production line such that they are arranged side-by-side in a row and crosswise to their longitudinal extension. In particular, they are guided over a drum from which respectively one cigarette filter rod is periodically removed at specific time intervals. The rod-shaped objects are generally deflected by an angle of approximately 90°, but are not limited to that.

European patent application No. EP 0 409 443 B1, which corresponds to U.S. Pat. No. 5,116,298, discloses a device of the aforementioned type that is used for removing cigarette filter rods and comprises a shuttle plate as a turning arrangement and a rotating device for rotating the shuttle plate. The rotating device rotates the shuttle plate between a first position in which a cigarette filter rod is picked up from the drum and a second position, in which the removed cigarette filter rod is pushed with compressed gas into a discharge pipe. In the second position, the cigarette filter rod is arranged orthogonal to the cigarette filter rods in the production line.

SUMMARY OF THE INVENTION

It is an object of the present invention to modify a device of the aforementioned type so that the design of the turning arrangement is simplified.

The above and other objects are accomplished according to the invention by the provision of a device for removing rod-shaped objects from a production line, comprising: a turning arrangement adapted for receiving the rod-shaped objects removed from the production line and comprising at least one, essentially fixed in place and rigid guide means for swiveling the rod-shaped objects; and transporting means for receiving the swiveled rod-shaped objects from the turning arrangement and for transporting the swiveled rod-shaped objects to a remote location.

With the at least one essentially fixed and rigid guide means according to the invention, the rod-shaped objects are moved with restricted guidance and, in the process, are subjected to a swiveling movement. As compared to prior art, the invention has the advantage that all movable parts are omitted, which not only leads to lower production costs, but also simplifies the maintenance during the operation and thus lowers the repair and maintenance costs.

The guide means preferably forms a guide surface, which is somewhat partially twisted around an axis extending approximately in the movement direction of the rod-shaped objects and positioned in the guide surface. Owing to the fact that the removed, rod-shaped object moves along the guide surface and essentially makes contact with this guide surface, the object is correspondingly turned as a result of the twisting of the guide surface.

Alternatively, the guide means can form a guide surface with a partial helical shape, for which the turning axis extends approximately in the movement direction of the rod-shaped objects. With this alternative embodiment, the guide surface is shaped and thus has the effect of a screw or spiral, on which or along which the removed rod-shaped object moves.

For a secure guidance, at least two spaced-apart guide elements must be provided, between which the rod-shaped objects are guided.

At least one guide element is required to guide the rod-shaped objects accordingly, wherein the guide element can be designed, for example, as a (preferably trough-shaped) slide.

However, several guide elements can also be arranged at a distance to each other and side-by-side in a row, which has advantages with respect to production technology, wherein it is useful if the several guide elements are arranged in two spaced-apart rows. For this, the guide elements (respectively) arranged in a row can be arranged in an imaginary plane or surface, which is somewhat partially twisted around an axis extending approximately in a movement direction of the rod-shaped objects and positioned in the plane, or has a partial helical shape with the rotational axis extending approximately in the movement direction of the rod-shaped objects.

For production technological reasons, it is particularly useful if the guide means is comprised of rods or bars, preferably with an essentially round cross section, or as sheet-metal guides. The use of, in particular, several rod-shaped or bar-shaped guide elements has the advantage that the turning arrangement can be more easily cleaned. In addition, round rods can generally be aligned well in a stay. However, other cross sectional shapes are conceivable as well, such as a triangular, oval, and the like.

The guide means comprising rod-shaped or bar-shaped guide elements or designed as sheet-metal guides, advantageously has the required twisted form corresponding to the aforementioned surface configuration. However, at least one pair of spaced-apart rod-shaped or bar-shaped guide elements or sheet-metal guides, which essentially follow the outer surface spanned by the one shell of a hyperboloid, can also be provided to achieve the desired turning movement of the rod-shaped objects guided between the two guide elements of such a pair.

A conveying device is normally provided, in which the rod-shaped objects are conveyed at an angle, preferably crosswise to their longitudinal extension.

In addition or alternatively, a conveying device of this type can also be designed for moving the rod-shaped objects under the effect of gravity to the turning arrangement. In that case, the guide means according to the invention can also take over a braking function. If the guide means comprises a plurality of guide elements, at least one of the many guide elements can advantageously be designed to have a braking effect on the guided, rod-shaped objects.

The conveyor furthermore can have a chute extending at an angle relative to a horizontal line, which is designed for transporting the rod-shaped objects.

The turning arrangement is normally followed by a device for transporting the rod-shaped objects to a remote location, wherein the transporting device is provided with a receptacle having a first opening for accepting the rod-shaped objects and a second opening for removing the objects by transporting them away. According to the invention, a design of this type has a closing element, which can be arranged such that it can move between a first position where it opens the first opening and preferably closes the second opening, and a second position where it closes the first opening and opens the second opening. The closing element is advantageously positioned such that it can swivel.

A particularly compact design of the device according to the invention can be achieved by arranging the turning arrangement at the closing element.

The closing element can be designed as a rocker with the turning arrangement sitting on the top, particularly if the turning arrangement conveys the rod-shaped objects under the effect of gravity.

BRIEF DESCRIPTION OF THE DRAWINGS

A preferred embodiment of the invention is explained in further detail in the following with the aid of the accompanying drawings.

DETAILED DESCRIPTION OF THE INVENTION

Figures 1, 2:
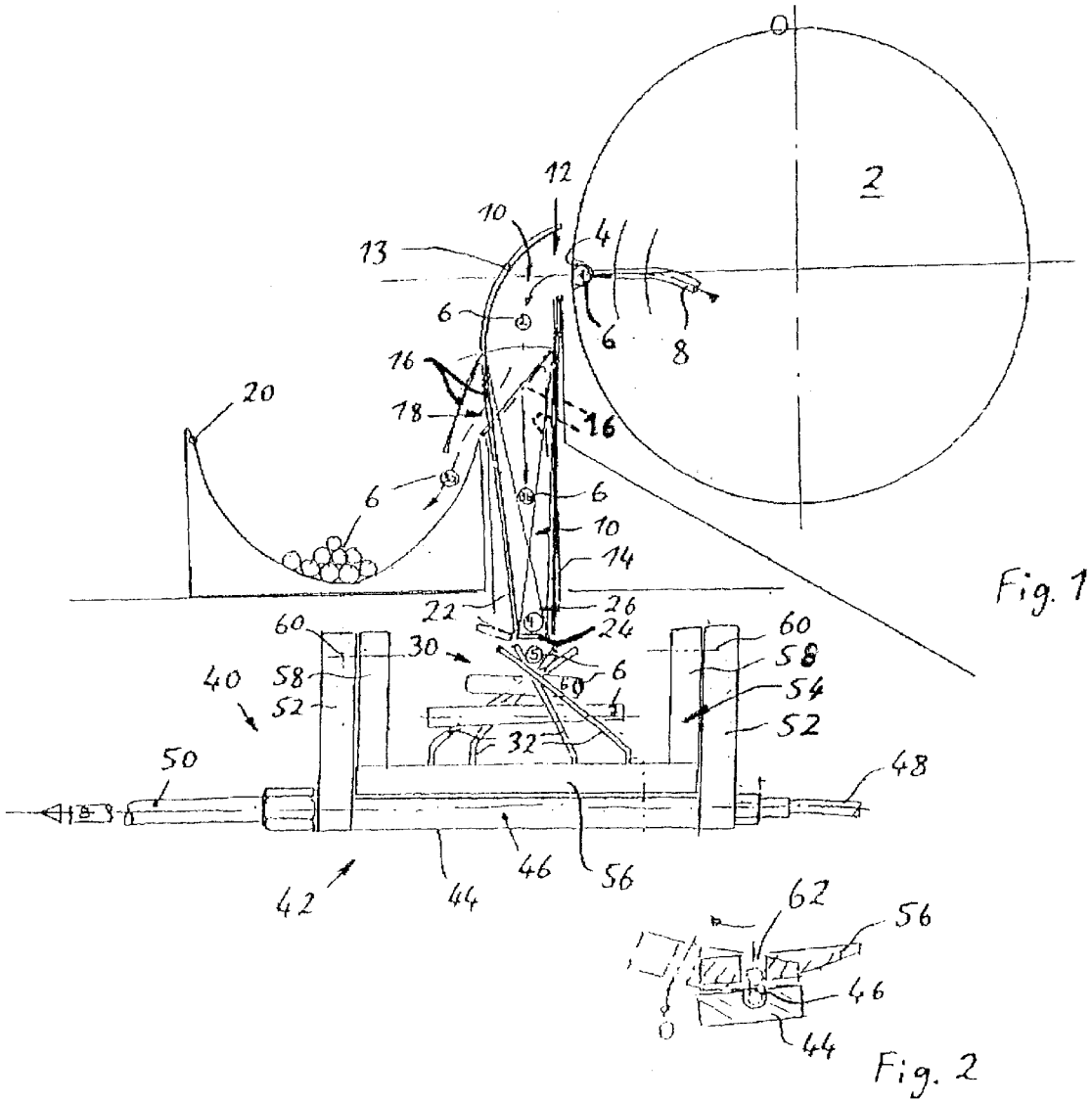
FIG. 1 shows a diagram of a configuration of a device for removing filter rods according to the invention.
FIG. 2 is a cross section, showing a detail of the pneumatic conveyor illustrated in FIG. 1.

Referring to FIG. 1, there is shown a drum 2, which is referred to as a pusher drum, which rotates around a center axis and forms a part of a production line for producing cigarette filters. Along the circumference of drum 2, axially extending grooves for holding filter rods are formed side-by-side, wherein respectively one groove holds one filter rod. For reasons of clarity, drum 2 in FIG. 1 shows by way of example only one groove 4 along the circumference, which accommodates a filter rod 6. Pneumatic channels inside the body of drum 2 lead to at least some of the grooves 4. FIG. 1 shows only one channel 8 leading to groove 4, again for reasons of clarity. The pneumatic channels 8 are connected to a compressed air source, not shown herein, which is controlled by a control device that is also not shown herein.

Owing to the axial arrangement of grooves 4, the filter rods 6 inside grooves 4 are transported crosswise to their longitudinal extension as a result of the rotation of drum 2. It must be noted here that filter rods 6 moving across drum 2 are longer than the filter pieces attached later on to the tobacco ropes to form the filter cigarettes. Thus, a plurality of filter pieces are cut from each filter rod 6 in a subsequent station along the production line.

In order to remove individual filter rods 6, a compressed-air source, not shown herein, is activated and compressed air is blown through those pneumatic channels 8, which lead to the respective grooves 4 from which a filter rod 6 is to be removed. In the process, the compressed-air source is controlled so that compressed air is blown to a groove only at specific time intervals or angular intervals. To remove samples, a removal chute 10 is provided, into which the individual filter rods 6 are blown with air blowing from drum 2. Attention must be paid to ensure that the corresponding groove 4 is correspondingly oriented and points toward the intake opening 12 of removal chute 10 for blowing out the filter rod 6, as shown in FIG. 1.

For the exemplary embodiment shown, the intake opening 12 of the removal chute 10 is arranged on the side of drum 2 and the filter rod 6 is essentially pushed in a horizontal direction from drum 2. However, for the exemplary embodiment shown, a sheet-metal catch 13 that delimits the removal chute 10 and is curved toward the bottom ensures that the pushed-out filter rod 6 is deflected toward the bottom, as further indicated with an arrow in FIG. 1. The largest part of the removal chute 10 consequently extends in a vertical direction. The filter rod drops under the effect of gravity through the chute and continues to move crosswise to its longitudinal extension. Adjacent to drum 2, removal chute 10 is delimited by a first vertical wall 14.

A V-shaped flap 16 is movably positioned below the curved sheet-metal catch 13. In a first position shown in FIG. 1 with dashed lines, this flap frees a first removal opening 18 on the side. The filter rod 6 can thus be guided under the effect of gravity to a drawer 20, arranged beside the removal chute 10, wherein the flap functions as a slide in this first position. In a second position, shown in FIG. 1 with drawn-out lines, the flap 16 closes the first removal opening 18 on the side. In that case, the filter rod 6 that drops down does not leave through the first side opening 18, but moves past this opening and further through the removal chute 10. The V-shaped flap 16, which is activated by a swiveling mechanism not shown in FIG. 1, therefore functions as a diverter.

Below the first removal opening 18 on the side, the removal chute 10 is delimited by a second wall 22, which is arranged at a distance to the first wall 14, wherein the two walls 14, 22 jointly form a funnel-shaped arrangement.

If the filter rod 6 drops further downward through the removal chute 10 while the flap 16 closes off the first removal opening 18 on the side, it hits a flap 24 on the lower end of the removal chute 10, which closes off a second, lower exit opening 26 of the removal chute 10. Flap 24 is positioned for pivoting between a closed position shown in FIG. 1 with drawn-out lines, in which it closes off the lower, second exit opening 26 of removal chute 10, and an opened position shown with dashed lines, in which it releases the lower, second exit opening 26 of removal chute 10. Flap 24 is activated by an operating device that is not shown herein. Once the filter rod 6 drops down through removal chute 10, flap 24 is initially closed, so that the filter rod 6 drops onto the closed flap 24. Once the filter rod 6 is positioned on the flap 24, this flap is deflected to the side and releases the filter rod 6, so that it drops from the lower, second exit opening 26 of removal chute 10.

Once filter rod 6 leaves lower second exit opening 26 of removal chute 10, it hits a downstream connected turning arrangement 30, which turns filter rod 6. Since filter rods 6 for the exemplary embodiment shown move through removal chute 10 and are guided by the effect of gravity, turning arrangement 30 is arranged directly below second exit opening 26 of removal chute 10. Turning arrangement 30 turns filter rods 6 around a rotational axis that extends at an angle, preferably a right angle, to their longitudinal axes and advantageously intersects with these in the center. For the exemplary embodiment shown, filter rods 6 are deflected by approximately 90° by turning arrangement 30, but the deflection is not restricted to this.

FIG. 1 shows that turning arrangement 30 for the exemplary embodiment consists of four rigid deflection and guide rods 32, fixedly mounted at a distance and relative to each other. These rods are arranged relative to each other and are twisted such that they correspondingly guide a filter rod 6 by subjecting it to a swiveling movement. A first pair of guide rods 32 oriented toward the observer of FIG. 1, and a second, rearward pair of guide rods 32, are respectively positioned to form an imaginary surface similar to the outer surface of one shell of a hyperboloid. This surface is somewhat partially twisted around an axis that extends approximately in the movement direction of the filter rods 6, meaning vertical for the exemplary embodiment, and positioned in the imaginary surface. The two pairs of guide rods 32 are at such a distance to each other that they can accommodate filter rods 6 between them and guide them in the manner described. Two spaced-apart rows of guide rods 32 are thus formed, which hold and guide the filter rods 6 between them. For this, each row of guide rods 32 can also contain more than the two guide rods 32 shown in FIG. 1.

The filter rods 6 are moved under the effect of gravity through the turning arrangement 30, in the same way as for the removal chute 10. In the process, they hit the upper ends of the guide rods 32 and are correspondingly turned because of their twisted arrangement. They continue to make contact with the guide rods 32 during their continued downward movement owing to gravity and thus slide along these guide rods.

Four guide rods 32 are provided for the exemplary embodiment shown. At least two of these guide rods 32 should definitely be arranged so that they can take on the previously mentioned guiding function while the remaining rods can be disposed or designed such that they can additionally or exclusively take over a braking function. In one preferred embodiment, six guide rods are provided, of which four can take on a guiding function and two a braking function.

Round guide rods 32 are selected for the exemplary embodiment shown because they can be oriented easily inside a stay (explained in further detail in the following). However, the use of other cross-sectional designs such as a triangular, oval, etc., which should have a round point in a downward direction, are conceivable as well.

The reason for selecting the arrangement of spaced-apart guide rods 32 for the exemplary embodiment shown is that it ensures an easy cleaning. In principle, even planar guide elements are conceivable, of which preferably at least two spaced-apart guide elements should be provided for holding and guiding the filter rods 6 between them, in the manner as described.

After the filter rod 6 has been correspondingly rotated inside the turning arrangement 30, it is moved to a pneumatic transporting device 40 with a dispatch station 42. Dispatch station 42 comprises a dispatch chamber section 44, which contains a dispatch chamber 46. FIG. 2 in particular shows that dispatch chamber 46 is an elongated groove with a U-shaped cross section that is open on the top. The elongated, groove-shaped dispatch chamber 46 is connected with one end (the right end according to FIG. 1) to a compressed-air line 48 that is supplied with compressed air from a non-depicted compressed-air source. With the other end (the left end according to FIG. 1), dispatch chamber 46 empties into a dispatch tube 50, which leads to a remote filter testing station that is not shown in the drawings.

A vertical support 52 is respectively arranged on the front of dispatch chamber section 44 of the dispatch station 42. Dispatch station 42 is furthermore provided with a swiveling trough 54, which has a closing segment 56 that extends across the top of the dispatch chamber section 44 and thus is oriented approximately horizontal, as well as respectively one upright standing arm 58 at each end of the closing segment 56. The swiveling trough 54 is positioned such that it can be swiveled with the upper ends of arms 58 via hinges that are not shown in the Figures. The hinges have a turning axis 60 extending in a horizontal direction. The swiveling trough 54 can thus be turned in the direction crosswise to the plane in FIG. 1.

FIG. 2 furthermore shows that the closing segment 56 of swiveling trough 54 is provided with a slot 62 that extends from the top to the bottom, wherein the width of this slot corresponds at least to the diameter of the filter rods 6. The slot 62 extends parallel to the groove-shaped dispatch chamber 46 and its length corresponds at least to the length of the filter rods 6 to be processed. The swiveling trough 54 can swivel between an opened position, shown in FIG. 2 with drawn-out lines, in which the slot 62 is directly above the dispatch chamber 46, and a closed position, shown in FIG. 2 with dashed lines, in which the closing section 56 closes off the groove-shaped dispatch chamber 46 that is open on the top.

According to FIG. 1, turning arrangement 30 consisting of guide rods 32 is arranged on top of the horizontally extending closing section 56 of swiveling trough 54. The lower ends of guide rods 32 are anchored inside bores in closing section 56, which are not shown herein. For this, turning arrangement 30 and through slot 62 are arranged relative to each other so that filter rod 6, which moves under the effect of gravity through turning arrangement 30, drops directly into slot 62.

Swiveling trough 54 should be in the open position while a filter rod 6 is guided through turning arrangement 30, so that the filter rod 6 entering slot 62 drops into the dispatch chamber 46 below and is held there. The swiveling trough 54 is subsequently turned to the closed position, thereby causing the closing section 56 to close off groove-shaped dispatch chamber 46 that is open on the top. By blowing compressed air from a compressed-air line 48 against the filter rod 6, the filter rod is blown from dispatch chamber 46 and into dispatch tube 50 and is transported in this tube to a remote filter testing station.

The swiveling trough 54 furthermore can be designed such that the connection between the dispatch chamber 46 and the dispatch tube 50 opens and closes selectively, that is to say counter to the opening and closing movement of the closing section 56, relative to the dispatch chamber 46. The advantage of this arrangement is that the dispatch tube 50 and, if necessary, the downstream installed additional pneumatic transporting devices can be put under pressure or kept under pressure and thus can remain pneumatically active, even if the dispatch chamber 46 is opened.

Figure 3:
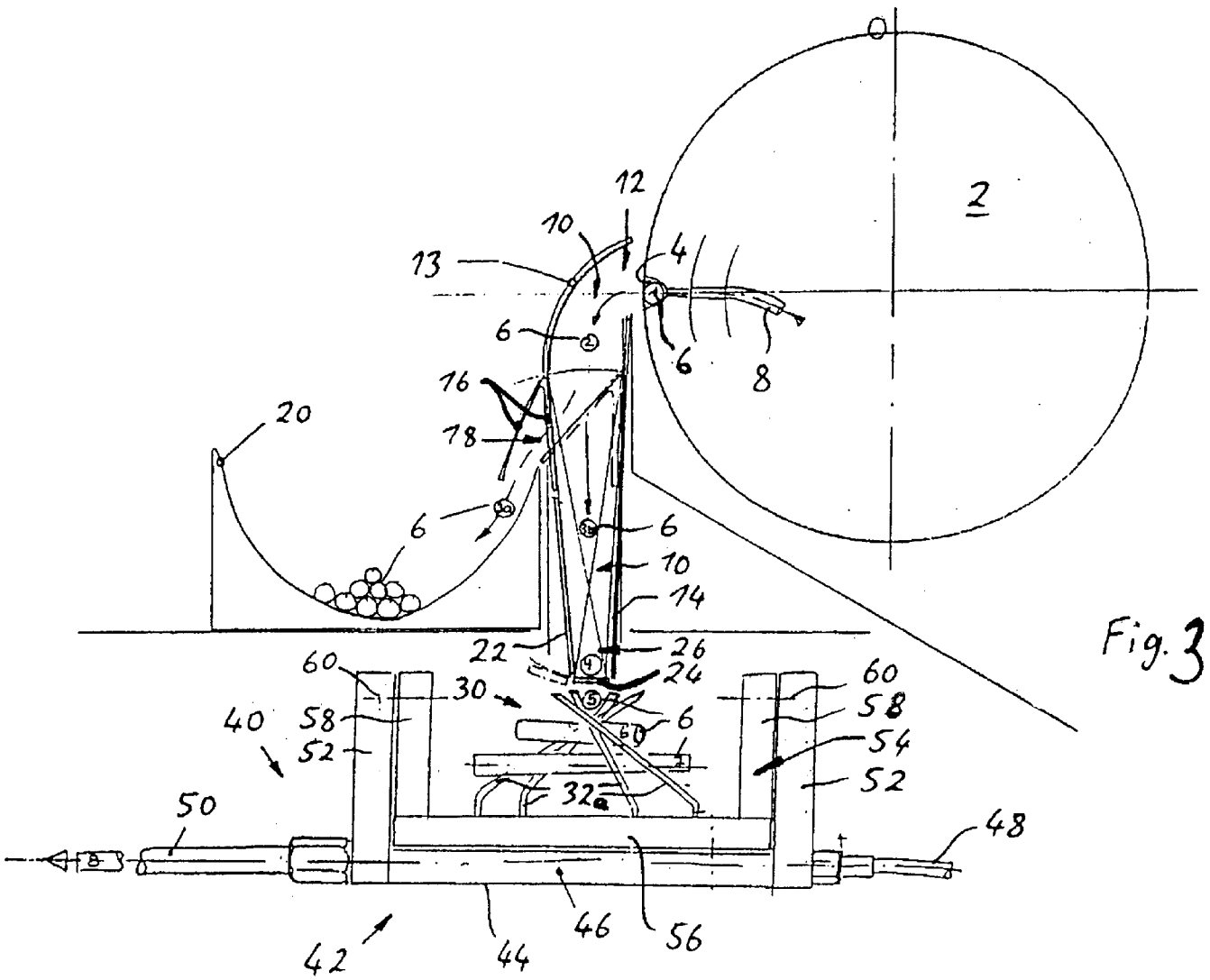
FIG. 3 shows a diagram of another embodiment of a device for removing filter rods according to the invention.

FIG. 3 shows another embodiment of the invention which is similar to FIG. 1 except that the guide mechanism is in the form of sheet-metal guides 32*a*.

The invention has been described in detail with respect to preferred embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. A device for removing rod-shaped objects from a production line, comprising:

a turning arrangement adapted for receiving the rod-shaped objects remove from the production line and comprising at least one, essentially fixed in place and rigid guide means for swiveling the rod-shaped objects; and transporting means for receiving the swiveled rod-shaped objects from the turning arrangement and for transporting the swiveled rod-shaped objects to a remote location, wherein the guide elements are rod shaped or bar shaped.

2. A device according to claim 1, wherein the guide means defines a guide surface which is partially twisted around an axis extending approximately in a movement direction of the rod-shaped objects and positioned in the surface.

3. A device according to claim 1, wherein the guide means defines a guide surface having a partial helical shape, the rotational axis of which extends approximately in a movement direction of the rod-shaped objects.

4. A device according to claim 1, wherein the rod-shaped or bar-shaped guide elements have an essentially round cross section.

5. A device for removing rod-shaped objects from a production line, comprising:

a turning arrangement adapted for receiving the rod-shaped objects remove from the production line and comprising at least one, essentially fixed in place and rigid guide means for swiveling the rod-shaped objects; and transporting means for receiving the swiveled rod-shaped objects from the turning arrangement and for transporting the swiveled rod-shaped objects to a remote location, wherein the guide means includes at least two spaced-apart guide elements between which the objects are guided, and wherein the guide elements are arranged to be spaced apart and side-by-side in at least one row.

6. A device according to claim 5, wherein the at least two guide elements arranged in two spaced-apart rows.

7. A device according to claim 5, wherein the guide elements arranged in the at least one row are positioned to define an imaginary surface which is partially twisted around an axis positioned in the surface and extending approximately in a movement direction of the rod-shaped objects.

8. A device according to claim 6, wherein the guide elements arranged in the rows are positioned to define an imaginary surface having a partial helical shape, for which the rotational axis extends approximately in a movement direction of the rod-shaped objects.

9. A device according to claim 5, further comprising a means for moving the rod-shaped objects at an angle to their longitudinal extension.

10. A device according to claim 9, wherein the moving means includes a chute that extends at an angle relative to a horizontal line for moving the rod-shaped objects.

11. A device according claim 5, wherein the guide means comprise sheet-metal guides.

12. A device according to claim 5, further comprising a means for moving the rod-shaped objects under the effect of gravity to the turning arrangement.

13. A device for removing rod-shaped objects from a production line, comprising:

a turning arrangement adapted for receiving the rod-shaped objects remove from the production line and comprising at least one, essentially fixed in place and rigid guide means for swiveling the rod-shaped objects; and transporting means for receiving the swiveled rod-shaped objects from the turning arrangement and for transporting the swiveled rod-shaped objects to a remote location, wherein the transporting means is arranged downstream of the turning arrangement for transporting the rod-shaped objects to the remote location, the transporting means comprising:

a receptacle including a first opening for receiving the rod-shaped objects and a second opening for discharging the received rod-shaped objects; and a closing element moveable between a first position for opening the first opening and second position for closing the first opening.

14. A device according to claim 13, wherein the closing element in the first position closes the second opening and in the second position opens the second opening.

15. A device according to claim 13, wherein the closing element is arranged such that it can swivel.

16. A device according to claim 13, wherein the turning arrangement is arranged on the closing element.

17. A device according to claim 13, wherein the closing element comprises a rocker and the turning arrangement is fitted on top of the rocker.

* * * * *